United States Patent [19]

Nakatani et al.

[11] Patent Number: 4,536,461

[45] Date of Patent: Aug. 20, 1985

[54] LAMINATED PHOTOSENSITIVE MATERIAL AND PROCESS FOR PRODUCTION THEREOF

[75] Inventors: Kaname Nakatani, Kawasaki; Junichi Hanna, Yokohama; Hiroshi Kokado, Tokyo, all of Japan

[73] Assignee: Mita Industrial Co., Ltd., Osaka, Japan

[21] Appl. No.: 620,967

[22] Filed: Jun. 15, 1984

[30] Foreign Application Priority Data

Jun. 15, 1983 [JP] Japan ..... 58-105938

[51] Int. Cl.[3] ..... G03G 5/06; G03G 5/14

[52] U.S. Cl. ..... 430/58; 430/59; 430/130

[58] Field of Search ..... 430/58, 59, 130

[56] References Cited

U.S. PATENT DOCUMENTS 3,895,944 7/1975 Wiedemann et al. ..... 430/59

FOREIGN PATENT DOCUMENTS 2037450 7/1970 Fed. Rep. of Germany ..... 430/130

50-53048 5/1975 Japan ..... 430/58

51-6731 1/1976 Japan ..... 430/58

56-40839 9/1981 Japan ..... 430/130

*Primary Examiner*—Roland E. Martin

*Attorney, Agent, or Firm*—Sherman & Shalloway

[57] ABSTRACT

Disclosed is a laminated photosensitive material for the electrophotography, which comprises an electroconductive substrate, a charge-generating layer composed of a vacuum deposition film of metal-free phthalocyanine formed on the substrate and a charge-transporting layer formed on the charge-generating layer, wherein the metal-free phthalocyanine film is a metal-free phthalocyanine particle layer composed mainly of α-type fine crystals having a crystal particle size of 100 to 2000 Å and the vacuum deposition film has a thickness of 500 to 3000 Å and a dark electroconductivity lower than $10^{-10}$ $(\Omega\text{-cm})^{-1}$.

In this laminated photosensitive material, the initial charge quantity is improved, and the electrophotographic characteristics are stabilized when the photosensitive materials is used repeatedly or continuously.

2 Claims, 5 Drawing Figures

LAMINATED PHOTOSENSITIVE MATERIAL AND PROCESS FOR PRODUCTION THEREOF

BACKGROUND OF THE INVENTION (1) Field of the Invention

The present invention relates to a laminated photosensitive material and a process for the production thereof. More particularly, the present invention relates to an improvement of a laminated photosensitive material comprising an electroconductive substrate, a charge-generating layer formed on the substrate by vacuum deposition of metal-free phthalocyanine and a charge-transporting layer formed on the charge-generating layer, wherein the charge quantity of the photosensitive material is increased and the electrophotographic characteristics at the time of repeated or continuous use are stabilized.

(2) Description of the Prior Art

A function-separated type electrophotographic photosensitive material comprising a charge-generating layer formed on a electroconductive substrate and a charge-transporting layer formed on the charge-generating layer has attracted attention as an organic photosensitive material excellent in electrophotographic characteristics such as the sensitivity. As the charge-generating layer of the photosensitive material of this type, various organic photoconductive pigments have been vacuum-deposited on substrates or resin dispersions of these pigments have been coated as substrates. Among these organic photoconductive pigments, metal-free phthalocyanine is stable against light, heat and discharge and has a sensitivity to longer wavelengths. Accordingly, researches have been made with a view to using metal-free phthalocyanine for a charge-generating layer.

When the vacuum deposition treatment metal-free phthalocyanine is carried out at a relatively low temperature, an $\alpha$-form crystal is formed, and if the treatment is carried out at a relatively high temperature a vacuum deposition film composed mainly of a $\beta$-form crystal is formed. The dark conductivity of a vacuum deposition film of an $\alpha$-form crystal is as high as $10^{-6}$ to $10^{-7}$ $(\Omega\text{-cm})^{-1}$, and the film is defective in that if a laminated photosensitive plate provided with this vacuum deposition film is used for the electrophotography, the initial charge voltage is relatively low and if the electrophotographic operation is repeated, the initial charge voltage is abruptly reduced.

SUMMARY OF THE INVENTION

It is therefore a primary object of the present invention to provide a laminated photosensitive material in which the above-mentioned defects of the conventional laminated photosensitive material are overcome.

Another object of the present invention to provide a function-separated type laminated photosensitive material in which the initial charge quantity is increased and the electrophotographic characteristics at the time of repeated or continuous use are stabilized, and a process for the production thereof.

Still another object of the present invention is to provide a process capable of producing the above-mentioned photosensitive material very simply and conveniently.

More specifically, in accordance with the present invention, there is provided a laminated photosensitive material for the electrophotography, which comprises an electroconductive substrate, a charge-generating layer composed of a vacuum deposition film of metal-free phthalocyanine formed on the substrate and a charge-transporting layer formed on the charge-generating layer, wherein the metal-free phthalocyanine film is a metal-free phthalocyanine particle layer composed mainly of $\alpha$-type fine crystals having a crystal particle size of 100 to 2000 Å and the vacuum deposition film has a thickness of 500 to 3000 Å and a dark electroconductivity lower than $10^{-10}$ $(\Omega\text{-cm})^{-1}$.

In accordance with the present invention, there also is provided a process for the production of a laminated photosensitive material comprising vacuum-depositing metal-free phthalocyanine on an electroconductive substrate and forming a layer of a charge-transporting substance on the vacuum deposition film, wherein metal-free phthalocyanine is vacuum-deposited in a thickness of 500 to 3000 Å on the electroconductive substrate maintained at a relatively low temperature and the formed vacuum deposition film is contacted with an aromatic organic solvent for a time sufficient to grow $\alpha$-form crystals substantially into $\alpha$-form crystals having a particle size of 100 to 2000 Å.

DETAILED DESCRIPTION OF THE PREFERRED EMBODIMENT

Figure 1:
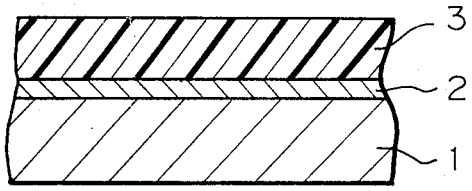
FIG. 1 is a diagram illustrating the sectional structure of a laminated photosensitive material of the present invention in which reference numeral 1 represents an electroconductive substrate, reference numeral 2 represents a charge-generating layer and reference numeral 3 represents a charge-transporting layer.

Referring to FIG. 1 diagrammatically illustrating the sectional structure of the laminated photosensitive material of the present invention, the photosensitive material comprises an electroconductive substrate 1, a charge-generating layer 2 formed on the substrate 1 and a charge-transporting layer 3 formed on the charge-generating layer 2. This charge-generating layer 2 is composed of a metal-free phthalocyanine vacuum deposition film.

The photosensitive material of the present invention is characterized in that the vacuum deposition film is formed of $\alpha$-form fine crystals having a crystal particle size of 100 to 2000 Å, especially 200 to 1000 Å, and the vacuum deposition film has a thickness of 500 to 3000 Å and a dark electroconductivity lower than $10^{-10}$ $(\Omega\text{-cm})^{-1}$.

Figure 2A:
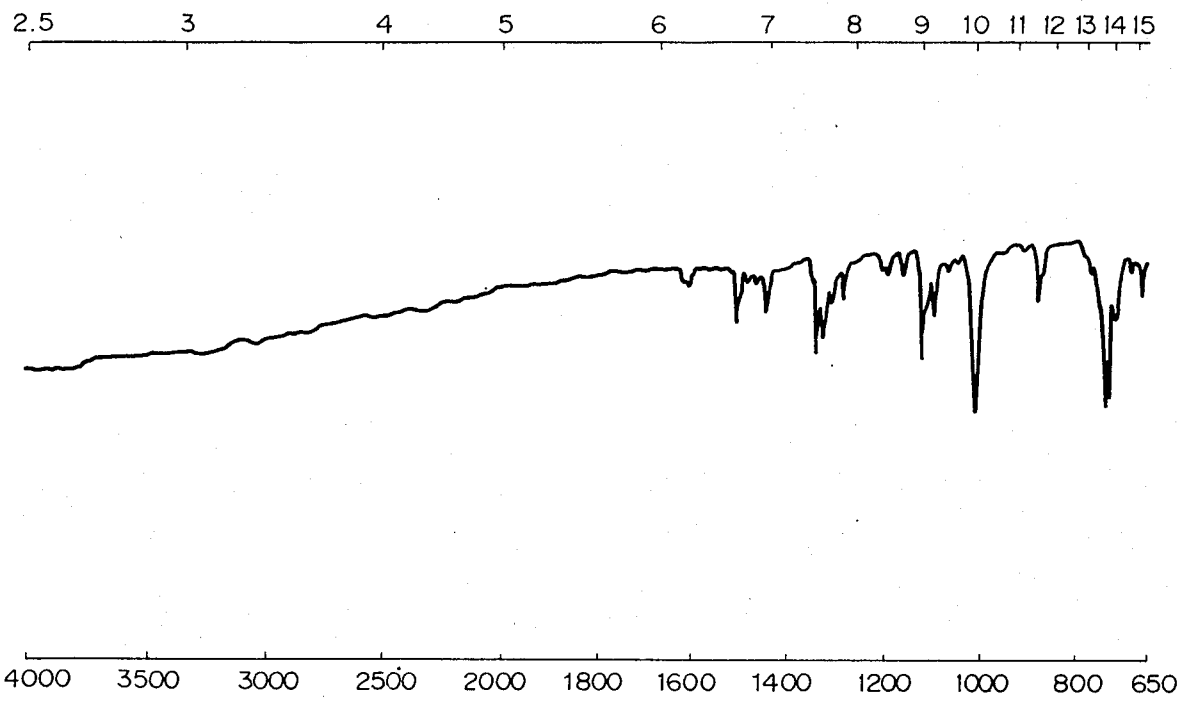
FIGS. 2-*a* and 2-*b* are diagrams showing the infrared absorption spectrum of a metal-free phthalocyanine layer used for the photosensitive material of the present invention.
Figure 2B:
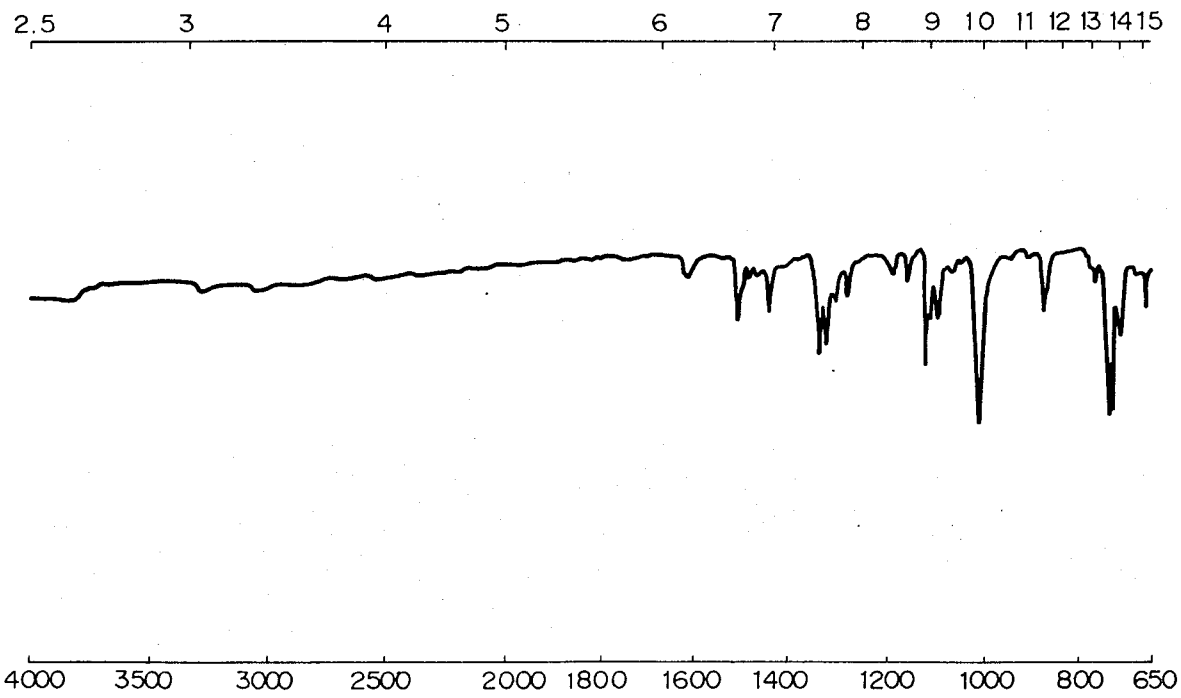

FIG. 2 shows the infrared absorption spectrum of the metal-free phthalocyanine layer used for the photosensitive material of the present invention, and from the characteristic absorption at 700 to 800 $cm^{-1}$, it is seen that the layer is composed mainly of $\alpha$-form crystals.

Figure 3:
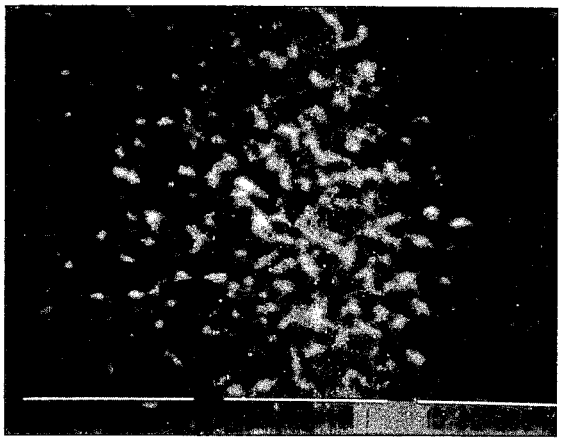
FIG. 3 is an electron microscope photograph (28,000 magnifications) showing the surface structure of a metal-free phthalocyanine layer used for the photosensitive material of the present invention.

FIG. 3 is an electron microscope photograph showing the surface structure of the metal-free phthalocyanine layer used for the photosensitive material of the present invention, in which the length of one white line corresponds to 1 micron (10000 Å). From this photograph, it will readily be understood that in the metal-free phthalocyanine layer in the present invention, phthalocyanine is present in the form of definite crystalline fine particles, and the metal-free phthalocyanine layer is formed of these particles.

Figure 4:
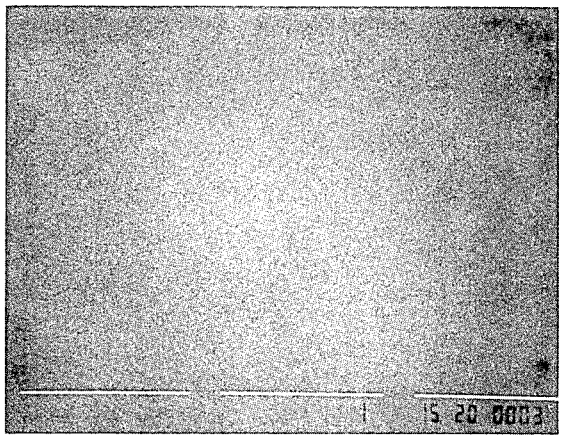
FIG. 4 is an electron microscope photograph (28,000 magnifications) showing the surface structure of a metal-free vacuum deposition film formed by the conventional vacuum deposition means.

FIG. 4 is an electron microscope photograph showing the surface structure of a metal-free phthalocyanine vacuum deposition film formed by the conventional vacuum deposition means. From this photograph, it is seen that the surface of the vacuum deposition film is very smooth, and the infrared absorption spectrum of this vacuum deposition, film is substantially the same as that shown in FIG. 2. Accordingly, it is considered that the crystal form of the metal-free phthalocyanine shown in FIG. 3 is the same as that of the metal-free phthalocyanine shown in FIG. 4 but in the metal-free phthalocyanine shown in FIG. 3, the crystals are sufficiently developed and grown into particles.

Moreover, the dark electroconductivity of the metal-free phthalocyanine vacuum deposition film of the type shown in FIG. 4 is as high as $10^{-6}$ to $10^{-7}$ $(\Omega\text{-cm})^{-1}$, while the metal-free phthalocyanine layer of the type shown in FIG. 3 has a dark electroconductivity lower than $10^{-10}$ $(\Omega\text{-cm})^{-1}$, namely, 1/1000 to 1/10000 of the dark electroconductivity of the vacuum deposition film of the type shown in FIG. 4.

In the case where a charge-transporting layer of polyvinyl carbazole is formed on a metal-free phthalocyanine layer as mentioned above, in case of the conventional type shown in FIG. 4, the initial charge voltage is 385 V and this is drastically reduced to 278 V when the photosensitive material is repeatedly used 5 times. On the other hand, in case of the type shown in FIG. 3, the initial charge voltage is 417 V and even if the photosensitive material is repeatedly used 5 times, the charge voltage is maintained at 412 V. Namely, according to the present invention, there can be attained prominent functional effects of improving the charge quantity and stabilizing the electrophotographic characteristic at the time of repeated use.

The layer of crystal particles of metal-free phthalocyanine shown in FIG. 3 is obtained by vacuum-depositing metal-free phthalocyanine on the electroconductive substrate maintained at a relatively low temperature, ordinarily at a temperature lower than 100° C., and contacting the formed vacuum deposition film with an aromatic organic solvent.

The vacuum deposition treatment can be accomplished by known means. Before the vacuum deposition treatment, metal-free phthalocyanine may be refined by washing with water or washing with a solvent such as tetrahydrofuran.

In the present invention, it is important that the thickness of the vacuum deposition film should be adjusted to 500 to 3000 Å. If the thickness of the vacuum deposition film is smaller than 500 Å, the light is not sufficiently absorbed and no satisfactory sensitivity is obtained. If the thickness of the vacuum deposition film is larger than 3000 Å, the adhesion of the phthalocyanine layer to the electroconductive substrate is reduced by the subsequent crystal-growing treatment and troubles such as peeling are readily caused.

The present invention is based on the novel finding that if this phthalocyanine vacuum deposition film is contacted with an aromatic organic solvent such as benzene, toluene, ethylbenzene or xylene, granulation is caused by development and growth of crystals while retaining the $\alpha$-form.

It is known that if phthalocyanine of the $\alpha$-form is treated with an organic solvent, it is converted to phthalocyanine of the $\beta$-form. However, if metal-free phthalocyanine in the form of a vacuum deposition film is contacted with an aromatic solvent according to the present invention, conversion of phthalocyanine of the $\beta$-form is not caused but prominent growth to crystal particles is caused instead.

The contact of the metal-free phthalocyanine vacuum deposition film with an aromatic solvent can be accomplished most conveniently by immersing the vacuum deposition film in the solvent. The contact conditions should be such that metal-free phthalocyanine is sufficiently grown into $\alpha$-form crystals having a particle size of 100 to 2000 Å. The contact temperature is ordinarily room temperature and the contact time is ordinarily in the range of from 25 to 40 hours. Of course, the contact may be carried out at an elevated temperature, and the treatment time may be shortened with elevation of the treatment temperature. The film treated with the solvent is dried.

A known charge-transporting layer is used as the charge-transporting layer in the present invention. For example, a charge-transporting resin such as polyvinyl carbazole or a resin dispersion of a charge-transporting low-molecular-weight substance such as a hydrazone derivative, an oxadiazole derivative, a triphenylamine derivative or a cumarine derivative may be used.

It is preferred that the charge-transporting layer be formed in a thickness of 1 to 30 microns on the phthalocyanine layer.

The present invention will now be described in detail with reference to the following example that by no means limits the scope of the invention.

EXAMPLE

Metal-free phthalocyanine (supplied by Tokyo Kasei) was washed with hot water one time and with tetrahydrofuran 2 times. Vacuum deposition was carried out on an aluminum substrate under a pressure of $5\times10^{-5}$ Torr at a substrate tmperature of 18° to 23° C. (room temperature) and a vacuum deposition rate of 10 Å/sec so that the film thickness was 500, 800 or 1500 Å. Two samples were prepared with respect to each thickness. One of the samples was immersed for about 36 hours in benzene purified by distillation and then dried in vacuum (hereinafter referred to as "solvent treatment"). Then, a 7% solution of poly-N-vinylcarbazole in monochlorobenzene was coated on all the metal-free phthalocyanine films at 1000 rpm for 15 seconds by a spinning coater, followed by drying. In each of the so-obtained function-separated electro-photographic photosensitive materials, the thickness of the poly-N-vinylcarbazole layer was 3 $\mu$m.

The electrophotographic characteristics of these photosensitive materials were examined by a device for measuring reduction of the charge voltage by light exposure where a sample stand was moved in parallel. The obtained results are shown in Table 1.

TABLE 1

| Treatment of Metal-Free Phthalocyanine Layer and Thickness [Å] of Metal-Free Phthalocyanine Layer | Characteristics at First Charging | | Characteristics after 5-Times Repetition | | Retention Ratio | |
|---|---|---|---|---|---|---|
| | Charge Voltage V1 [V] | Light Sensitivity G1 | Charge Voltage V5 [V] | Light Sensitivity G5 | V5/V1 [%] | G5/G1 [%] |
| solvent treatment | | | | | | |
| 500 | −550 | 0.08 | −547 | 0.08 | 99 | 100 |
| 800 | −525 | 0.12 | −528 | 0.12 | 100 | 100 |
| 1500 | −417 | 0.12 | −412 | 0.12 | 99 | 100 |
| untreated | | | | | | |
| 500 | −500 | 0.08 | −480 | 0.07 | 96 | 88 |
| 800 | −480 | 0.15 | −405 | 0.10 | 84 | 67 |
| 1500 | −385 | 0.16 | −278 | 0.10 | 72 | 63 |

Note
Measurement Conditions
Charge voltage: saturation surface voltage by corona charger at −6 KV
Light sensitivity: xerographic gain calculated from initial light decay speed observed when irradiated with monochromatic light of 615 nm at intensity of $1 \times 10^{14}$ photons/cm$^2 \cdot$ s From the results shown in Table 1, it will readily by understood that by the solvent treatment of a metal-free phthalocyanine vacuum deposition film, the charge voltage of a laminated photosensitive material is improved and the stability against the repeated operation is drastically enhanced.

What is claimed is:

1. A laminated photosensitive material for the electrophotography, which comprises an electroconductive substrate, a charge-generating layer composed of a vacuum deposition film of metal-free phthalocyanine formed on the substrate and a charge-transporting layer formed on the charge-generating layer, wherein the metal-free phthalocyanine film is a metal-free phthalocyanine particle layer composed mainly of α-type fine crystals having a crystal particle size of 100 to 2000 Å and the vacuum deposition film has a thickness of 500 to 3000 Å and a dark electroconductivity lower than $10^{-10}$ (Ω-cm)$^{-1}$.

2. A process for the production of a laminated photosensitive material comprising vacuum-deposition metal-free phthalocyanine on an electrodoncuctive substrate and forming a layer of a charge-transporting substance on the vacuum deposition film, wherein metal-free phthalocyanine is vacuum-depositied in a thickness of 500 to 3000 Å on the electroconductive substrate maintained at a relatively low temperature and the formed vacuum deposition film is contacted with an aromatic organic solvent for a time sufficient to grow α-form crystals substantially into α-form crystals having a particle size of 100 to 2000 Å.

* * * * *